US005439177A

United States Patent [19]

Graf et al.

[11] Patent Number: 5,439,177

[45] Date of Patent: Aug. 8, 1995

[54] DISCHARGE HEAD FOR DISCHARGE APPARATUSES SUCH AS MANUAL PUMPS FOR DISCHARGING MEDIUM THERETHROUGH

[75] Inventors: Lothar Graf, Rielasingen/Worblingen; Peter Pfeiffer, Gaienhofen; Ernst Buhr, Radolfzell, all of Germany

[73] Assignee: Ing. Erich Pfeiffer GmbH & Co. KG, Germany

[21] Appl. No.: 930,414

[22] PCT Filed: Mar. 12, 1991

[86] PCT No.: PCT/EP91/00455

§ 371 Date: Nov. 16, 1992

§ 102(e) Date: Nov. 16, 1992

[87] PCT Pub. No.: WO92/15660

PCT Pub. Date: Sep. 17, 1992

[30] Foreign Application Priority Data

Mar. 14, 1990 [DE] Germany ..... 40 08 070.6

[51] Int. Cl.[6] ..... B05B 11/00

[52] U.S. Cl. ..... 239/333; 239/338; 239/541; 239/579; 222/321.1; 222/378

[58] Field of Search ..... 239/333, 338, 493, 541, 239/573, 579; 222/321, 378, 402.1

[56] References Cited

U.S. PATENT DOCUMENTS

| | | | |
|---|---|---|---|
| 2,989,251 | 6/1961 | Abplanalp et al. | 239/573 X |
| 3,180,536 | 4/1965 | Meshberg | 239/579 X |
| 3,211,346 | 10/1965 | Meshberg | 222/321 |
| 3,257,043 | 6/1966 | LeFevre | 239/350 X |
| 3,583,605 | 1/1969 | Corsette | 222/321 |
| 3,669,359 | 6/1972 | Focht | 239/579 X |
| 3,684,185 | 8/1972 | Milcos | 222/402.1 X |
| 4,071,196 | 1/1978 | Burke et al. . | |

FOREIGN PATENT DOCUMENTS

| | | |
|---|---|---|
| 131501 | 1/1985 | European Pat. Off. . |
| 2178658 | 11/1973 | France . |
| 2588490 | 4/1987 | France . |
| 2645835 | 10/1990 | France . |

*Primary Examiner*—William Grant
*Attorney, Agent, or Firm*—Quarles & Brady

[57] ABSTRACT

A discharge head has an operating cap and a discharge connection for fitting on the operating shaft of a discharge apparatus. The discharge head has a shaft over most of its length positioned in contact-free manner within an outer sleeve of the discharge connection, and which is provided with a connecting member for fitting on the operating shaft. The other shaft end of the discharge head shaft is only fixed by press fit in a short inner sleeve and forms a nozzle core, and at the end a free-standing end wall, at which the medium is transversely deflected from a central portion of an outlet channel and is supplied via longitudinal channels to a discharge opening.

19 Claims, 3 Drawing Sheets

39
43
21
12
3
5

12
29
32
34
35
39
43
33
31
36
21
22
23
29
24
25
12
26
27

18
37
21
17
16
25
15
29
12
28
1
10
26
9
2
8
4
7
5
6
3

DISCHARGE HEAD FOR DISCHARGE APPARATUSES SUCH AS MANUAL PUMPS FOR DISCHARGING MEDIUM THERETHROUGH

BACKGROUND OF THE INVENTION

The invention relates to a discharge head, such as is, e.g., used as an operating handle and/or discharge connection on manually operable discharge apparatuses for flowable media, such as liquid, pasty or similar media.

The discharge head can, as a closed subassembly, be subsequently fixed to the completed discharge apparatus having a valve tappet or a pump piston shaft, e.g., solely by means of a plug-in connection, in that a shaft end of the discharge head is fitted onto the valve tappet or pump piston shaft.

FR-A-2,178,658 discloses a discharge head, onto whose basic body is shaped a long shaft with a relatively large diameter inside cross-section and which is fitted onto the pump piston shaft. To reduce the internal dead volume in the shaft, use is made of a filter.

If the shaft is constructed in one piece with the basic body, then the same discharge head basic body can only be connected to a specific size of tappet. The situation is much the same if the pump piston forms an assembly unit with the discharge head.

FR-A-2,588,490 describes a foam discharge head for valves on pressure containers, in which the discharge head is mounted by means of a short, thick adaptor to the valve shaft.

SUMMARY OF THE INVENTION

The device according to the invention obviates the disadvantages of known contructions, and in particular provides a discharge head which, in the case of simple construction, can be adapted to different discharge apparatuses and optionally to different discharge openings.

According to the invention a separate shaft can be fixed by a plug-in connection particularly exclusively by press fit, to the discharge head. The shaft preferably forms with one end a connecting member for direct connection to the operating member of the discharge apparatus and/or with the other end forms a profiled shaft end, which is, e.g., used for guiding the medium flow in varying directions. Preferably, said shaft end is so inserted in a short, freely projecting inner sleeve of the discharge head, that most of the shaft length is located entirely in contact-free manner within the discharge head.

The shaft or the shaft end arranged in a fixed manner in the discharge head appropriately has longitudinally connected shaft portions of different external diameter and appropriately in the vicinity of the connecting member is provided the largest shaft width, and at the other end the smallest shaft width. In the manner of a sleeve or muff, the connecting member has a central plug opening for receiving the operating member of the discharge apparatus.

Substantially independently of this construction of the discharge head, it can also be advantageous if the shaft end associated with the discharge opening forms a reduced nozzle core with an end wall, axially adjacent to which the nozzle core is circumferentially traversed by at least one passage opening, which connects a portion of the outlet channel located entirely within the shaft to a portion located on the outer circumference of the shaft. The end wall, which can be connected in one piece in the manner of a U-shaped bridge via two legs to the remaining shaft, can have on its end face, e.g., for the formation of a twisting device, grooves, depressions, etc. and with said end face can engage on a substantially uninterrupted, inner face of the discharge head, which is traversed by a nozzle channel forming the discharge opening. Thus, solely through the use of another shaft, it is possible to modify the flow influencing of the medium prior to entering the nozzle channel.

The outlet channel portion located within the shaft appropriately has on the part of its length connected to the transverse channel or on its entire length cross-sections which diverge from the circular shape, which are e.g. approximately flat rectangular or radial in such a way that e.g. three flat groove cross-sections uniformly distributed about a central axis are connected to one another with their open longitudinal sides facing the central axis.

These and further features of preferred developments of the invention can be gathered from the claims, description and drawings and the individual features, both singly and in the form of subcombinations, can be realized in an embodiment of the invention and in other field and can represent advantageous, independently protectable constructions.

BRIEF DESCRIPTION OF THE DRAWINGS

Embodiments of the invention are described in greater detail hereinafter relative to the drawings, wherein.

DETAILED DISCUSSION

Figure 1A:
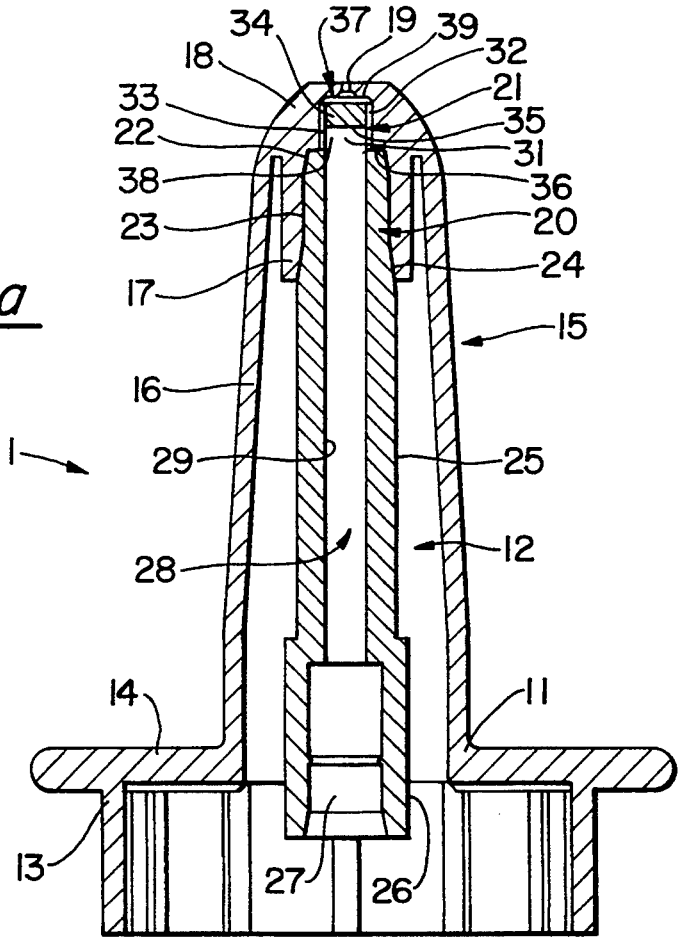
FIG. 1*a* is an axial section view of an invention discharge head.

The discharge head 1 according to FIG. 1*a* is used for the operation and medium connection to a discharge apparatus 2, which e.g., has a thrust piston pump 3 with a piston unit 4 displaceable in a cylinder casing 5. The casing 5, which can also be formed by a container for single emptying, which is closed at the bottom end faces the piston unit 4, is here fixed in sealed manner with the aid of a cap 7 with an inserted cylinder cover or a circumferential flange against the end face of the neck of a medium container 6, into which the casing 5 projects with an end having an intake valve. The piston unit 4 forms an outlet valve 8 for a pump outlet channel traversing it in the interior up to an operating shaft 9. The operating shaft 9 serves as the single connection located within the central axis 10 of the pump 3 of the discharge apparatus 2 to the discharge head 1 by means of an axial clamp or plug connection.

The discharge head 1 formed by two plastic injection moldings has an outer, completely exposed, casing-like, hollow basic body 11 and a one-piece shaft 12, which is open at both ends and tubular, and is located in a completely flush manner in said body 11, and which only in the vicinity of a short end is in direct, completely encased contact with the body 11. At one end the basic body 11 forms a flat, widened cap 13, in which projects in the assembled state the projecting end of the casing 5 or the cylinder cover. The closed end wall of said cap 13 forms a pressure handle 14 for operating the pump 3.

Over the end wall projects a discharge connection 15 which is significantly reduced compared with the cap 13 and is formed by an outer sleeve 16 connected by one end in one piece to the end wall and an inner sleeve 17 extending only over a small part of its length. With its end remote from the cap 13, the inner sleeve 17 passes in one piece into the associated end of the outer sleeve 16 and forms therewith a nozzle cap 18. The external circumference of the inner sleeve 17 projecting freely against the cap 13 is substantially contact-free over its entire length relative to the inner circumference of the outer sleeve 16. At the end of the discharge connection 15 the end wall of the nozzle cap 18 is traversed by a nozzle channel of an atomizing nozzle, which forms the discharge opening 19 of the discharge apparatus 2.

With an external diameter-multiply stepped shaft end 20, which only corresponds to approximately a quarter of the total length of the shaft 12, the latter is pressed in a firmly seated manner into the inner sleeve 17 and the nozzle cap and is exclusively fixed in this way. It is conceivable to provide on the inner circumference of the outer sleeve 16 support ribs or the like, which secure the shaft 12 in position on the outer circumference at a distance from the inner sleeve 17. As the associated end portion of the shaft 12, the shaft end 20 forms a nozzle core 21 closely engaging in a bore of the nozzle cap 18, and which has the smallest external diameter of all the shaft portions and extends up to the inner end of the nozzle channel or the approximately planar base face of the bore surrounding the same in an annular manner.

In the vicinity of the transition between the outer and inner sleeves 16 and 17, the nozzle core 21 passes via an approximately planar ring shoulder 36 into a short, acute-angled, conical shaft portion 22, to which is continuously connected a substantially cylindrical shaft portion 23. The shaft portion 23 within the inner sleeve 17 passes into a wider, acute-angled, conical shaft portion 24 in continuous manner, which projects beyond the free end of the inner sleeve 17, and to which is continuously connected the longest, through, cylindrical shaft portion 25. The shaft portion 25 is free from a closed jacket surrounding in engaging manner its outer circumference and at the end remote from the shaft end 20 passes into a widened sleeve-like connecting member 26, which opposite the end wall passes in contact-free manner into the cap 13, but is set back with respect to the open cap side. With its inner circumference the connecting member 26 forms a plug-in opening 27, whose bottom is defined by a ring shoulder and which is adapted to the operating shaft 9 in such a way that the latter can be inserted until its end engages on the ring shoulder. At the insertion end the plug-in opening 27 can be widened in funnel-like manner and has between its ends at least one projecting torus as a seal and clamping zone for the operating shaft 9.

The shaft 12 forms a portion 29 of an outlet channel 28 to be connected by said plug-in connection to the pump outlet channel of the operating shaft 9. The portion 29 extends from the connecting member 26 to the nozzle core 21 or to the ring shoulder 36 and is bounded in bore-like manner exclusively by the jacket of the shaft 12 and is free from inserted parts. In the vicinity of the ring shoulder 36 the outlet channel 28 passes into a transverse channel 31 diametrically traversing the shaft 12 and which is provided over its entire length with substantially constant cross-section and which has roughly the same flow cross-section as the portion 29. The transverse channel 31 traverses the outer circumference of the shaft 12 only in the vicinity of the nozzle core 21 with two remote passage openings 33, which are the same width as the channel 31 and are connected to the ring shoulder 36.

Thus, the nozzle core 21 forms an end wall 34 facing with the spacing of the ring shoulder 36, and whose inside 35 bounds the transverse channel 31, and which is connected in one piece to the shaft portion 22 or the ring shoulder 36 by two facing legs 38 laterally bounding the transverse channel 31 and the passage openings 33. Longitudinal channels 32 extend from the ring shoulder 36 to the end face 39 of the shaft 12 or to the outside of the end wall 34, and of these each connects a passage opening 33 to a common twisting device 37 directly adjacent to the inner end of the nozzle channel. Each longitudinal channel 32 is formed by an axial groove, whose bottom face is appropriately curved about the central axis 10 and which has the same width or is wider than the associated passage opening 33 and the through-flow cross-section thereof is appropriately constant over its length. The grooves are provided in the outer circumference of the nozzle core 21 and are closed on the open groove longitudinal sides by the associated inner circumference of the nozzle cap 18.

The ring shoulder 36 engages closely on a corresponding ring shoulder of the nozzle cap 18, in which also engage the shaft portions 22, 23 and 24 in tight, self-locking manner. In the case of pump actuation, the medium flows through the channel portion 29 and the transverse channel 31 into the significantly narrower longitudinal channels 32 and then into the even narrower connecting channels provided in the end face 39 through which the medium is given a rotary flow about the nozzle axis and is then finely atomized by the nozzle channel for use.

For assembly purposes the discharge head 1 can be fitted onto the operating shaft even after fixing the pump 3 to the container 6, because pump actuation limited by the abutment of the piston unit 4, as a result of the volume conditions provided, at the most leads to a medium filling of the channel portion 29, but not to a medium discharge. In the starting position of the pump the connecting member 26 can engage in the casing or the cylinder cover, and in the pump stroke end position is completely located within the casing 5.

According to FIGS. 2 to 5 the shaft portion 25 passes with an approximately continuous external diameter up to the ring shoulder 36 or the nozzle core 21, and at the end can have a chamfered shaft portion 22 for easier insertion in the inner sleeve 17 cylindrically over the entire length on the inner circumference.

Figures 2, 3, 4, 5, 6:
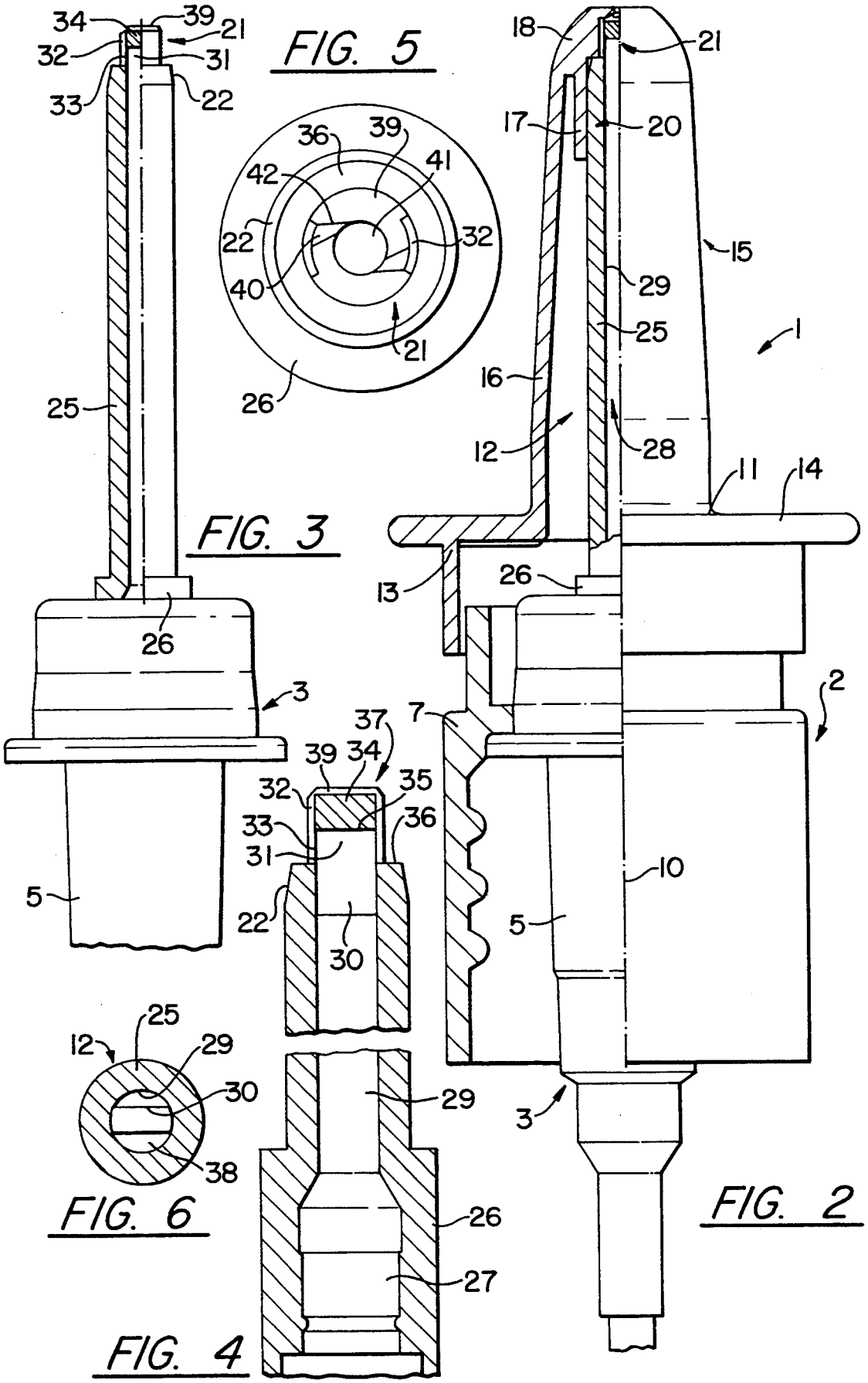
FIG. 2 is a partial axial section view of another embodiment of a discharge head.
FIG. 3 is a view of the arrangement according to FIG. 2, but without the discharge head basic body.
FIG. 4 is a view of the shaft of the discharge head according to FIG. 2 in axial section and on a larger scale.
FIG. 5 is a longitudinal view of the shaft according to FIG. 4 on a larger scale.
FIG. 6 is a cross-section view through the shaft according to FIG. 4.
Figures 7, 8, 9, 10:
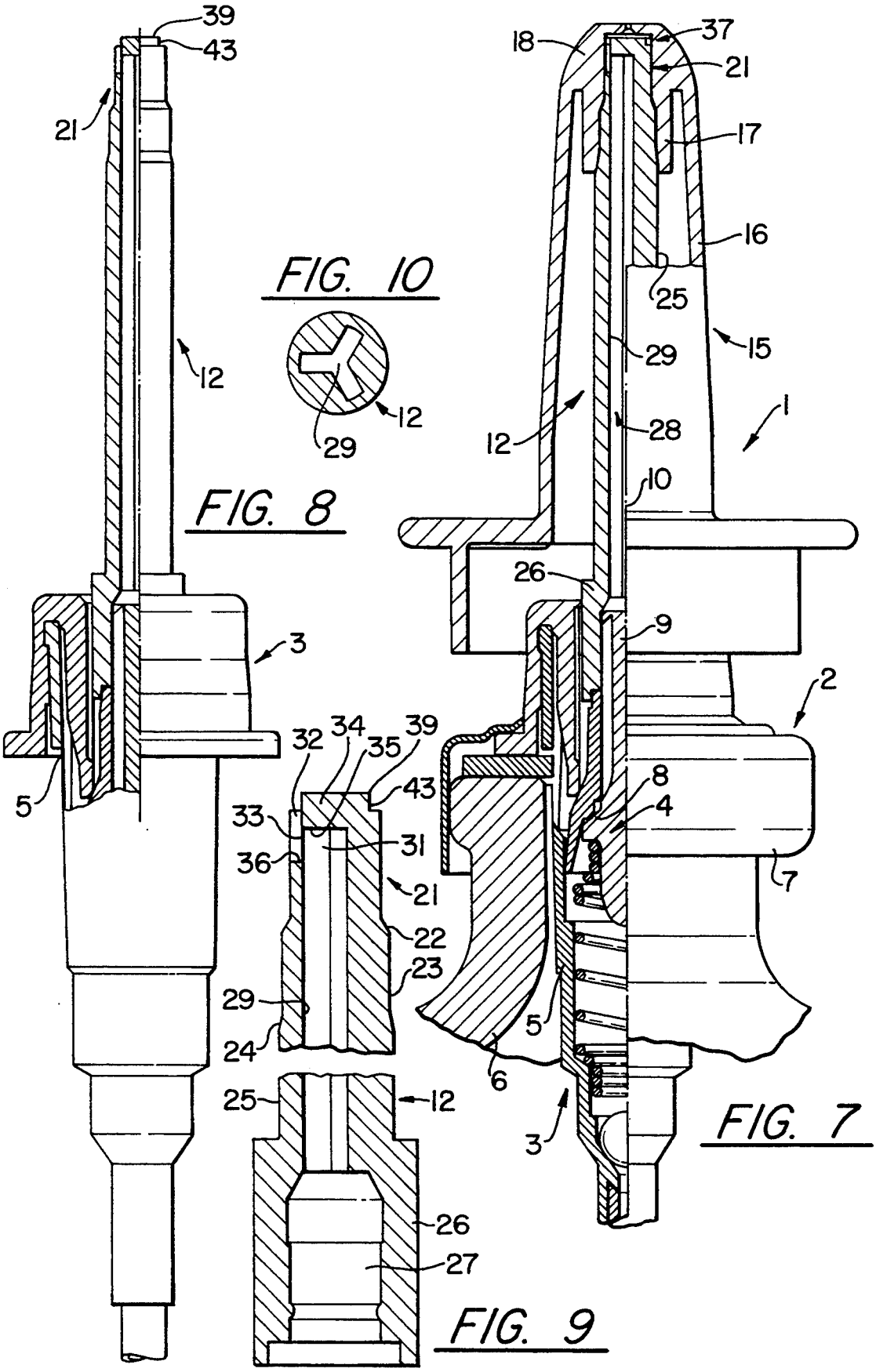
FIG. 7 is a view as in FIG. 2 of another embodiment of a discharge head.
FIG. 8 is a side view of the discharge head according to FIG. 7 with its basic body removed.
FIG. 9 is a view of the shaft according to FIG. 7 in a larger scale axial section.
FIG. 10 is a cross-section view through the shaft according to FIG. 9.

At a short distance upstream of the transverse channel 31 the cylindrical portion 29 of the outlet channel 28 passes into a narrower portion 30, which according to FIG. 6 has a flat cross-section in such a way that as a result legs 38 are formed, so that the external diameter of the nozzle core 21 can be roughly the same as the portion 29, or is only larger than its internal diameter by the depth of the longitudinal channels 32.

According to FIG. 5 each longitudinal channel 32 is ring segmented in cross-section, and is connected by means of a connecting channel 40 in a roughly tangential manner to central chamber or depression 41. The connecting channel 40 and the depression 41 are formed by recesses in the end face 39. In the direction of the depression 41 from the longitudinal channel 32, each connecting channel 40 decreases in cross-section in wedge-like manner, and at the wider inlet end has only roughly half as large a flow cross-section as the longitudinal channel 32, and namely only extends over part of the width of said channel 32. A spline 42 of the groove-like connecting channel 40 extends tangentially approximately from one flank of the longitudinal channel 32 to the inner circumference of the circular depression 41, whose diameter is roughly the same as the width of the channel 32. Thus, with a simple construction a high atomizing action is obtained.

Figure 1B:
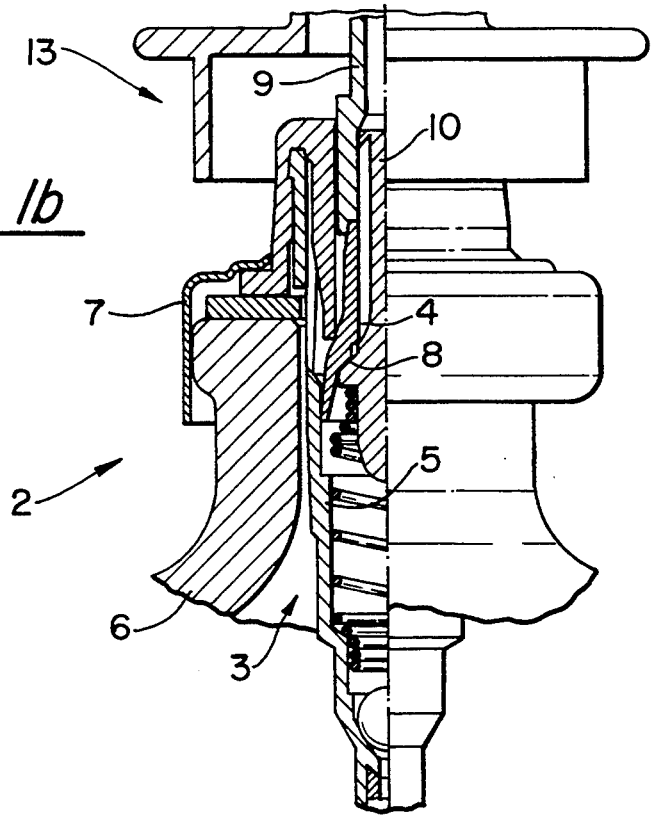
FIG. 1*b* is a partial sectional view of a portion of the discharge apparatus of the invention.

According to FIG. 4 the connecting member 26 has a multiply diameter-reduced plug-in opening 27 and at its open end a widened portion for receiving a correspondingly widened collar of the operating shaft 9 in which, according to FIGS. 1*a* and 1*b*, a shaft part of the piston core of the piston unit 4 can be inserted in such a way that a piston sleeve is fixed with a predetermined axial tension.

According to FIGS. 7 to 10 the external circumference of the nozzle core 21 passes directly into the shaft portion 22. At the free end the nozzle core 21 is provided with a stepped ring shoulder 43, which with the nozzle cap 18 forms a ring channel on the outside of the end wall 34. In the vicinity of the portion 29, the outlet channel 28 forms three longitudinal groove-like, but intercommunicating channels arranged radially around the central axis 10, and which extend up to the inside 35 of the end wall 34. One to all the groove channels are in which case connected by means of a transverse channel 31 and a passage opening 33 to a longitudinal channel 32, which issues into the ring shoulder 43. Thus, it is possible to provide three uniformly circumferentially distributed transverse channels 31 and correspondingly arranged passage openings 33, as well as longitudinal channels 32. The particular passage opening 33 is located roughly in the plane of the base wall of the associated groove channel of the portion 39. The partition 34 is connected by means of three legs to the closed jacket of the nozzle core 21 and in each case between two adjacent legs is provided a passage opening 33.

The shoulder 36 facing and bounding the passage opening 33 of the portion 39 is spaced upstream of the shaft portion 22 in the jacket of the nozzle core 21. If the shaft is encased by the inner sleeve over a greater length or up to the connecting member 26, then the transverse channel 31 can also be much nearer the connecting member and the longitudinal channels 32 are correspondingly lengthened.

Each described feature can be provided in all the embodiments.

We claim:

1. A discharge head (1) for operating a discharge apparatus (2) for discharging a medium, said discharge head (1) comprising:

a body (11) providing an outer member (16) and a holding member (17) freely projecting within said outer member (16), said outer member (16) having a circumferential inner surface, and said holding member (17) having a circumferential outer surface substantially free of contact with respect to said inner surface;

a discharge outlet (19) for expelling said medium therethrough, said discharge outlet (19) including a discharge duct having an inner discharge duct end; and an elongated operating shaft (12) providing a component separate from said body (11), and defining a shaft length extension including first and second length extensions, said operating shaft (12) having connecting means (27) for operably connecting said discharge head (1) with an operating member (9) of the discharge apparatus (2) for effecting discharge of said medium by operating the operating member (9) through said operating shaft (12), said operating shaft (12) having first and second shaft end sections (20, 26) defining said first and second length extensions, said first shaft end section (20) engaging said holding member (17) in a manner seated entirely over said first length extension, thereby providing a remaining length section (25, 26) of said operating shaft (12) defining a remaining length extension, said first length extension being shorter than said remaining length extension, and a turbulence device (37) being provided and including a turbulence member (34, 38) for guiding the medium in varying directions, and said turbulence member (34, 28) being provided by said first shaft end section (20).

2. The discharge head according to claim 1, wherein said second shaft end section (26) includes said connecting means (27), an intermediate shaft section (25) connects said first and second shaft end sections (20, 26), and said intermediate shaft section (25) is longer than each of said first and second shaft end sections (20, 26).

3. The discharge head according to claim 1, wherein over most of said shaft length extension said operating shaft (12) is free of contact with respect to said body (11) and is located within said body (11), and said first shaft end section (20) engages inside said holding member (17).

4. The discharge head according to claim 1, wherein said outer member (16) defines a front end, said holding member (17) having a connecting end connected to said front end in one part, said outer member (16) and said holding member (17) commonly providing an outlet cap (18), including a cap end wall, said cap end wall being penetrated by said discharge duct, said first shaft end section (20) having outer section faces including an outer circumferential face and an end face, and at least one of said outer section faces providing a duct face (32, 39, 40, 41) for the medium.

5. The discharge head according to claim 4, wherein said circumferential face provides said duct face (32).

6. The discharge head according to claim 4, wherein said circumferential face is penetrated by at least one passage opening (33) for the medium.

7. The discharge head according to claim 4, wherein said first shaft end section (20) has an end wall (34) providing said end face (39) and an inside face (35), said end wall (34) providing said turbulence member (21) and said end face (39) providing said duct face (40, 41).

8. The discharge head according to claim 7, wherein said end face (39) has at least one depression (40, 41) for guiding the medium.

9. The discharge head according to claim 7, wherein said inside face (35) bounds at least one passage opening (33) for the medium, said passage opening (33) penetrating said circumferential face, said inside face (35) bounding an outlet channel (29, 31) for the medium, and said outlet channel (29, 31) being for connecting the operating member (9) with said medium outlet (19).

10. The discharge head according to claim 1, wherein said body (11) has an operating handle (14) for operating the discharge apparatus (2), said operating handle being provided by an end wall (14) of said body (11), said outer member (16) being reduced with respect to and emanating from said end wall (14) to an outer end having said holding member (17), said holding member (17) freely projecting towards said end wall (14), said outer member (16) and said holding member (17) in one part commonly providing a nozzle cap (18) penetrated by said discharge duct, said discharge outlet (19) having an atomizing nozzle, and said first shaft end section (20) including a nozzle core (21) engaging inside said nozzle cap (18), and said holding member (17) being shorter than said outer member (16).

11. The discharge head according to claim 1, wherein within said holding member (17) said first shaft end section (20) has a shoulder (36), said turbulence member (34, 38) connecting to said shoulder (36) and providing an end wall (34) spaced from said shoulder (36).

12. The discharge head according to claim 11, wherein said end wall (34) provides an end face (39) of said first shaft end section (20), said turbulence device (37) provides a medium chamber (41) and is located directly adjacent to said inner discharge duct end, and said end face (39) bounding said medium chamber (41).

13. The discharge head according to claim 12, wherein said medium chamber provides duct portions (40, 41) for the medium including at least one of:

at least one transverse medium duct (40); and a central chamber depression (41), at least one of said duct portions (40, 41) being bounded by both said first shaft end section (20) and said body (11).

14. The discharge head according to claim 13, wherein at least one of said duct portions (40, 41) is provided in said end face (39), at least one of said transverse medium duct (40) providing at least one of a duct decreasing in cross-section to provide a wedge shape, and a duct bounded by a flank (42) tangentially connecting to an inner circumference of said central chamber depression (41) provided in said end face (39).

15. The discharge head according to claim 11, wherein said turbulence member (34, 38) has an outer circumference penetrated by at least one transverse passage opening (33) and providing at least one longitudinal duct section (32) connecting said passage opening (33) with said discharge duct, said passage opening (33) being located directly adjacent to said shoulder (36), said longitudinal duct section (32) being provided by a groove in said outer circumference and being closed at said outer circumference by said body (11), and said shoulder (36) engaging a counter shoulder of said body (11).

16. The discharge head according to claim 1, wherein said first shaft end section (20) has at least one of partial sections including at least one conical section (22, 24), a cylindrical section (23), and a stepped section (21) connecting to a shoulder (36).

17. The dispenser according to claim 1, wherein said operating shaft (12) is made in one part, said first shaft end section (20) fixedly engaging said holding member (17) which is made in one part with said body (11) and said outer member (16).

18. The dispenser according to claim 17, wherein said outer member (16) is an outer sleeve making up a discharge portion (15), said discharge portion (15) freely projecting from an enlarged end wall (14) and spacedly enveloping said holding member (17) provided by a holding sleeve freely projecting towards said enlarged end wall (14), said outer member (16) and said holding member (17) having ends commonly providing an outer end wall (18), said discharge duct penetrating said outer end wall (18) and said inner discharge duct end connecting to said first shaft end section (20).

19. The discharge head according to claim 18, wherein said enlarged end wall (14) is an end wall (14) of a cap (13) provided to receive a closure of the discharge apparatus, said enlarged end wall (14) providing an operating handle connectable to the discharge handle for operating a piston pump (3) of the discharge apparatus (2).

* * * * *